US007703149B2

(12) United States Patent
Ward, Jr.

(10) Patent No.: US 7,703,149 B2
(45) Date of Patent: Apr. 27, 2010

(54) PROTECTIVE COVERS FOR DRIVERS AND VEHICLE PASSENGERS

(76) Inventor: Lucilious Ward, Jr., 4915 York St., Denver, CO (US) 80216

( * ) Notice: Subject to any disclaimer, the term of this patent is extended or adjusted under 35 U.S.C. 154(b) by 256 days.

(21) Appl. No.: 11/838,004

(22) Filed: Aug. 13, 2007

(65) Prior Publication Data

US 2008/0289074 A1 Nov. 27, 2008

Related U.S. Application Data

(63) Continuation-in-part of application No. 11/751,378, filed on May 21, 2007.

(51) Int. Cl.
*A41D 13/04* (2006.01)

(52) U.S. Cl. ..... 2/48; 2/49.1; 2/49.3

(58) Field of Classification Search ..... 2/48, 2/49.1–49.5, 50, 51, 52, 88, 46, 174, 87, 2/104, 114; 297/182, 228, 219.1; 4/521, 4/245.1, 245.3, 245.4, 245.7, 245.8; 296/39.1; 150/158

See application file for complete search history.

(56) References Cited

U.S. PATENT DOCUMENTS

| | | | | | |
|---|---|---|---|---|---|
| 284,671 | A | * | 9/1883 | Reed | 2/49.5 |
| 742,059 | A | * | 10/1903 | Peterson | 2/51 |
| 1,135,833 | A | | 4/1915 | Morse | |
| 1,538,982 | A | | 5/1925 | Glover | |
| 1,970,307 | A | | 8/1934 | Hartmann | |
| 1,979,879 | A | | 11/1934 | Harris | |
| 2,364,258 | A | | 12/1944 | Wallace | |
| 2,457,725 | A | * | 12/1948 | Bauer | 2/49.5 |
| 2,594,053 | A | * | 4/1952 | Mckewen | 2/49.5 |
| 2,879,514 | A | * | 3/1959 | Shapiro | 2/48 |
| 2,907,042 | A | * | 10/1959 | Murphy | 2/48 |
| 3,115,639 | A | | 12/1963 | Moszczynski | |
| 3,665,518 | A | * | 5/1972 | Leadford | 2/88 |
| 3,803,640 | A | * | 4/1974 | Ericson | 2/114 |
| 4,014,045 | A | * | 3/1977 | Moyer | 2/51 |
| 4,660,224 | A | | 4/1987 | Ashcraft | |
| 4,837,859 | A | | 6/1989 | Hamberg | |
| 4,958,577 | A | | 9/1990 | Demaio | |
| 5,075,897 | A | | 12/1991 | Daniels | |
| 5,181,275 | A | | 1/1993 | Spulgis | |
| 5,220,692 | A | | 6/1993 | Cox | |
| 5,244,278 | A | | 9/1993 | Robitaille | |

(Continued)

OTHER PUBLICATIONS

PCT International Search Report; PCT/US08/63297; Aug. 29, 2008.

*Primary Examiner*—Amy B Vanatta
(74) *Attorney, Agent, or Firm*—Hogan & Hartson LLP

(57) ABSTRACT

A bib for use by an individual seated in a vehicle having a vehicle cup holder mounted in the vehicle adjacent the seated individual, includes an upper section for covering at least a portion of the seated individual's front torso which is attached in such a way as to maintain the upper section in a substantially vertical position on the seated individual, a lower section for covering the seated individual's lap and thighs, and a lateral section extending from the lower section to beyond the vehicle cup holder, with a portion of the lateral section adapted to be inserted in the vehicle cup holder and releasably maintained therein. The bib includes an upper absorbent surface for absorbing liquid spills and a lower impermeable surface for preventing liquid spills from contacting the seated individual or the vehicle.

20 Claims, 5 Drawing Sheets

U.S. PATENT DOCUMENTS

| | | | | |
|---|---|---|---|---|
| 5,509,141 | A | 4/1996 | Saltzman | |
| 5,513,576 | A | 5/1996 | Ward | |
| 5,530,968 | A | 7/1996 | Crockett | |
| 5,621,916 | A | 4/1997 | Bell | |
| 5,671,479 | A | 9/1997 | Dedrick | |
| 5,701,605 | A | 12/1997 | Bowen | |
| 5,960,472 | A | 10/1999 | Reid | |
| 6,095,058 | A | 8/2000 | Earnhart | |
| 6,243,869 | B1 | 6/2001 | Ekovich | |
| 6,484,333 | B1 | 11/2002 | Hill | |
| 6,839,907 | B2 | 1/2005 | Katz | |
| 6,948,187 | B2 * | 9/2005 | Drake | 2/51 |
| 7,158,376 | B2 | 1/2007 | Richardson et al. | |
| 7,178,170 | B2 | 2/2007 | Thompson | |
| 7,566,328 | B2 * | 7/2009 | Hooper | 604/357 |
| 2001/0054191 | A1 | 12/2001 | Frye | |
| 2005/0045792 | A1 | 3/2005 | Onizawa et al. | |
| 2005/0120457 | A1 * | 6/2005 | Mesalic | 2/49.1 |
| 2007/0028343 | A1 * | 2/2007 | Makowka | 2/48 |
| 2008/0060109 | A1 * | 3/2008 | Ottah et al. | 2/50 |
| 2008/0092263 | A1 * | 4/2008 | Good et al. | 2/49.1 |
| 2008/0172768 | A1 * | 7/2008 | DeStefano | 2/49.2 |

* cited by examiner

PROTECTIVE COVERS FOR DRIVERS AND VEHICLE PASSENGERS

RELATED APPLICATION

The present application is a continuation-in-part application of co-pending U.S. Ser. No. 11/751,378 filed May 21, 2007, which is incorporated herein in its entirety by this reference.

1. FIELD OF THE INVENTION

The present invention relates to bibs for use by drivers and passengers in automobiles and other vehicles.

2. BACKGROUND OF THE INVENTION

Infant bibs are traditionally used minimize spillage of food on the infant's clothing during feeding. Infant bibs typically have opposing ties which tie at the back of the infant's neck, to maintain the bib in place. Often, the bib is made of layers of washable vinyl and terry cloth or other cotton or cotton-like fabric, so that food will not seep through the bib and stain the infant's clothes, and the dirty bib can be washed and reused. Primary concerns in the design and distribution of infant bibs is that they be sturdy and reusable, minimize risk of injury to the infant and keep food from contacting the infant's clothes.

Bibs are also used by adults during particularly messy meals when dining at restaurants, for example, at crab festivals or when eating barbequed foods. Typically, these bibs are merely large polyethylene sheets which tie behind the diner's neck and have a food-related design on the front.

Specialized bibs have been designed for adults when driving cars or other vehicles. For example, U.S. Pat. No. 5,075,897 entitled Multi-Purpose Protective Garment, discloses a multi-purpose garment made of an absorbent textile material designed to protect the lap and chest while commuting. It is worn by a strap from the neck to prevent spills and stains from clothing worn while commuting. The bib has a chest covering portion and a lap portion, which may be folded on top of each other to form a seat cushion, provide a surface on which to change an infant, form a tote bag or act as an apron.

U.S. Pat. No. 5,701,605 entitled Auto Bib with Integral Tray Portion, discloses a foldable and reusable bib, which protects the front torso and lap of an individual seated in a motor vehicle, and includes a flat, relatively stiff sheet. The bib includes an integral tray or lower section. The lower portion includes an optional cup holding means for holding a drinking cup in a relatively upright and secure position. The cup holding means is illustrated as positioned in approximately the center of the individual's lap. The top surface of the flat sheet is disclosed as relatively impervious to liquid spills.

Also by way of example, U.S. Pat. No. 6,095,058 entitled Lap Beverage/Cup Holder with Wings, discloses a lap mat for overlaying a person's lap which includes openings for holding a beverage container and food items for convenience when operating or riding in a vehicle. The opening for the beverage container is illustrated as positioned in approximately the center of the lap mat. A pocket on the underside of the mat below the openings provides thermal insulation and containment of the beverage. The lap mat is also intended to protect the person's lap and clothing from spills.

U.S. Pat. No. 5,530,968 entitled Commuter's Apron, discloses an apron for containment of food and drink spillage in for vehicle drivers and passengers, which the vehicle is moving or stopped. The aprons are formed from material impervious to liquids and other spills. The patent describes an apron shape in which a plurality of aprons are cut from an elongate sheet of material in an economical manner due to the generally convex upper edge and generally concave lower edge which match one another exactly on adjacent end-to-end apron blanks.

U.S. Pat. No. 5,621,916 entitled Bib for Use While Operating a Vehicle, discloses a bib to be worn while an operator is controlling a vehicle. The bib in narrower at the neck portion and at the opposing end which is secured to the steering column by a steering column ring. In a preferred embodiment, the portion intermediate the neck portion and the opposing end is of greater width than the opposing ends.

U.S. Pat. No. 5,220,692 entitled Driver's Apron, disclosure an apron worn by a the driver of a vehicle which protects the driver's clothing from spilled food or beverage or falling cigarette or cigar ashes when the drive is eating or smoking while driving. The apron includes a torso panel to which is removably connected a neck strap, and also a lap panel to cover the thighs and knees. The sides of the lap panel are stiffened by weights maintaining the lap panel flat on the thighs and preventing it from creeping up over the knees despite movement of the driver's legs. The apron is made of water-repellent, moisture-breathing, fire retardant fabric.

U.S. Pat. No. 5,513,576 entitled Adjustable Lap Table discloses a self adjusting lap table having a strap which maintains the table in a coiled position when not in use. When uncoiled, the table is positioned on the lap of with the opposing lateral edges curved downward around the user's legs. An opening for holding a drinking cup or other item is positioned between the user's legs.

U.S. Pat. No. 6,484,333 entitled Fire Retardant Lap Protection Cloth disclose a fire retardant lap protection cloth to be placed across the lap of a drive or passenger of a vehicle to protect clothing and vehicle seats from tobacco burns or soiling. The cloth is disclosed as comprising layers of different materials. The cloth is taught as naturally forming a depression between the user's legs and thighs, effective for catching debris. The cloth is shown as extending laterally over but not substantially beyond the sides of the user's thighs.

However, such bibs do not address all the problems associated with eating and drinking in automobiles, trucks or other vehicles. For example, the center console to the side of the driver in many vehicles now include cup holders which extend over a portion of the console and retract when not in use. Other center consoles have one or more cylindrical holes formed therein for placing a beverage container. Spillage can occur not just over the chest or lap of the driver, but also in the path from the individual's mouth to the cup holder, for example, over the vehicle's console. Accordingly, it is not just the driver's clothing and vehicle seat which needs to be protected from spills, but also the center console, which in some vehicles, is covered with cloth, leather, or wood, and may be stained or otherwise damaged.

Of course, spillage beyond the lap of an individual may also be problematic for a vehicle's passengers, who may be using a cup holder mounted in a center mounting which extends from a center armrest, or a cup holder permanently and/or non-retractably mounted or formed in the center of the vehicle or adjacent or on the door of the vehicle. Passenger spills also easily occur when a cup or can is being placed in or removed from such cup holders.

Thus it can be seen that there remains for a means of not only protecting a driver or passenger in a vehicle from beverage spills, there is also a need to protect the vehicle's console from liquid spills. Further, there remains a need to protect the areas in the back passenger seats adjacent the passengers, for example the seat cushions to the sides of the passengers, from beverage spills.

SUMMARY OF THE INVENTION

The present invention relates to spill protection devices for drivers and passengers in vehicles. In an embodiment of the present invention, a bib for use by an individual seated in a vehicle having a vehicle cup holder mounted in the vehicle adjacent the seated individual includes an upper section for covering at least a portion of the seated individual's front torso. The bib includes attachment means associated with the upper section of the bib for maintaining the upper section in a substantially vertical position on the seated individual. The bib also includes a lower section for covering the seated individual's lap and thighs and a lateral section extending from the lower section to beyond the vehicle cup holder. A portion of the lateral section is adapted to be inserted in the vehicle cup holder, and preferably is maintained in place by structures such as a cylindrical shape formed in the lateral section adapted to be received in the cup colder, an adhesive on the underside of the lateral section, magnetic material embedded in the lateral section, or other material in which at least a portion of the lateral section has a density, weight or tackiness sufficient to frictionally engage at least a portion of the cup holder or adjacent console, and thereby prevent slippage out of the cup holder. Preferably, the bib includes an upper absorbent surface for absorbing liquid spills and a lower impermeable surface for preventing liquid spills from contacting the seated individual or the vehicle.

In one embodiment of a bib of the present invention, the shape of the bib and the size of the lateral section are designed for general usage in any of a variety of vehicles, by having sufficiently large lower and lateral sections to allow a portion of the lateral section to be inserted in a wide variety of vehicle console configurations, with excess bib material draped loosely between the driver and the cup holder being used. In another embodiment of the present invention, the shape and size of the bib, especially the lower and lateral sections, are dimensioned to fit a particular vehicle model and cup holder location. Optionally, the bib may be sized for different-sized drivers, for example, in small, medium, large and extra-large sizes.

BRIEF DESCRIPTION OF THE DRAWINGS

The aforementioned and other features and objects of the present invention and the manner of attaining them will become more apparent and the invention itself will be best understood by reference to the following description of a preferred embodiments taken in conjunction with the accompanying drawings, wherein.

DETAILED DESCRIPTION

Figure 1:
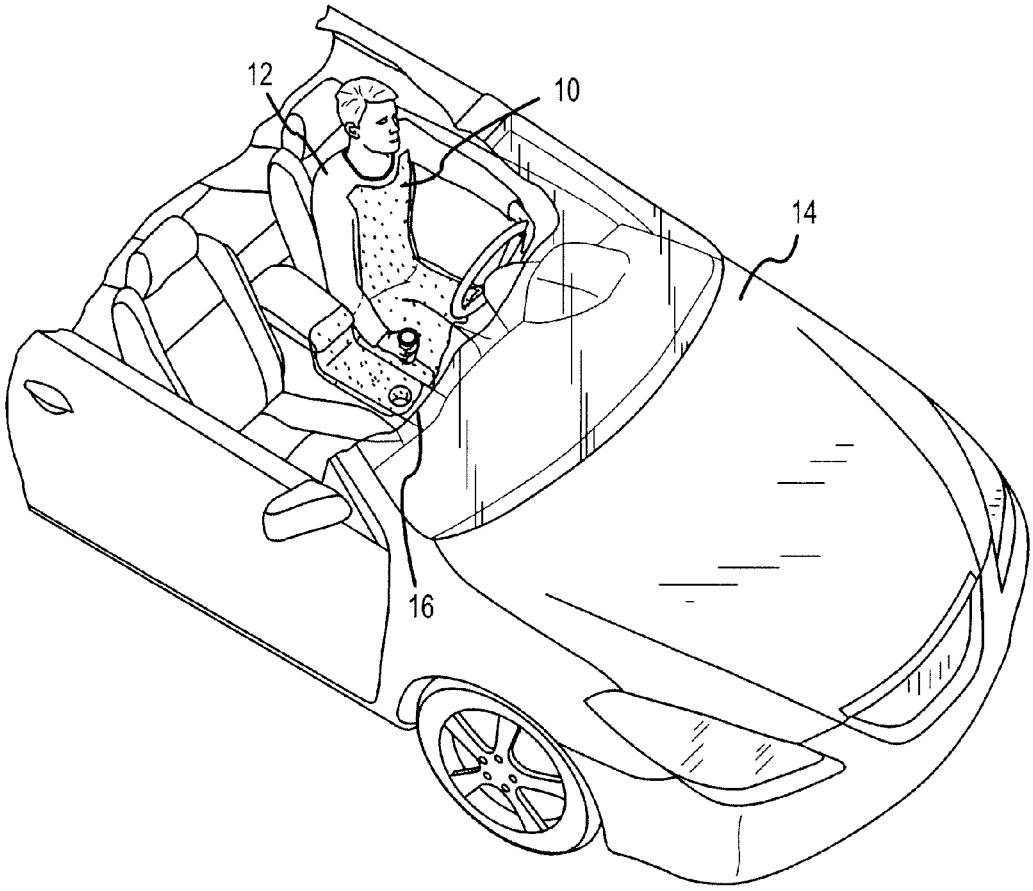
FIG. 1 illustrates an embodiment of a bib of the present invention for use by an individual seated in a vehicle having a vehicle cup holder mounted in the vehicle adjacent the seated individual.

The present invention relates to spill protection devices for drivers and passengers in vehicles. Referring to FIG. 1, in a preferred embodiment of the present invention, a bib 10 for use by an individual 12 seated in a vehicle 14 having a vehicle cup holder 16 mounted in the vehicle adjacent the seated individual is shown. Bib 10, as further shown in FIG. 2, includes an upper section 20 for covering at least a portion of the seated individual's front torso.

Figure 2:
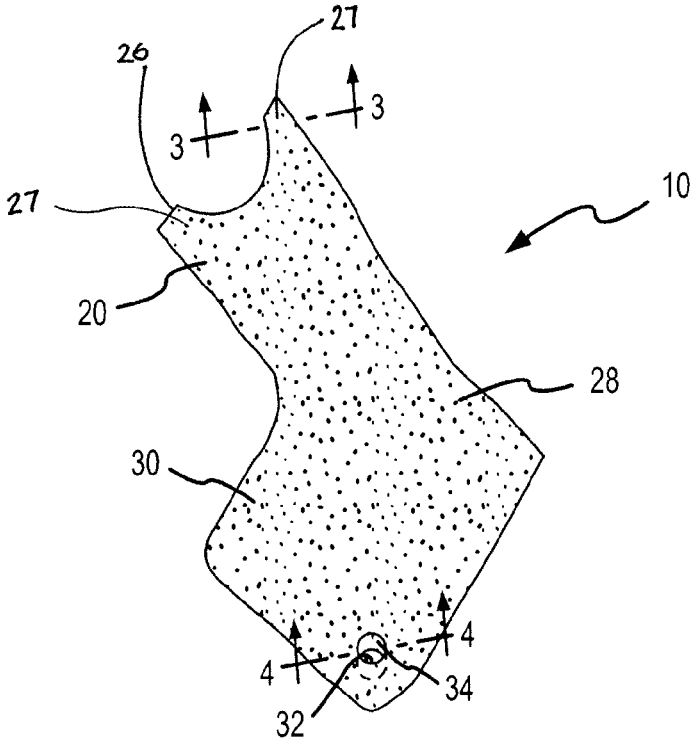
FIG. 2 illustrates the bib shown in FIG. 1.
Figure 3:
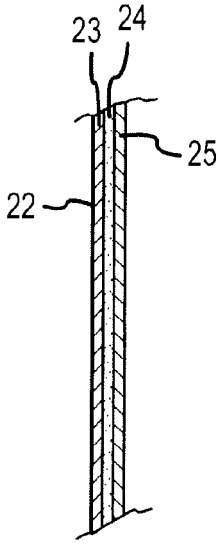
FIG. 3 is a cross-section of the bib shown in FIG. 2 through section 3-3.

Bib 10 also includes attachment means associated with upper section 20 for maintaining the upper section in a substantially vertical position on the seated individual. As shown in FIG. 3, a preferred attachment means of the embodiment shown in FIGS. 1, 2 and 3 comprises an adhesive layer 22 which is formed on a waterproof or impermeable lower layer 23 of bib 10. An intermediate absorbent layer 24, which may be made from cellulose or other absorbent material, mounted over lower layer 23, which in turn, is preferably covered by a covering layer 24, preferably of a tissue-like material. It should be understood, however, that additional layers may be present, or one or more layers omitted, for example, if the tissue layer is deemed unnecessary in certain embodiments, or adhesive is applied to only selected portions of the lower layer 23, or other additional layer(s) may be incorporated into a bib of the present invention, to provide additional functionality to bib 10. When the attachment means comprises an adhesive layer 22, the adhesive is selected so as to releasably bond with the outer clothing of individual 12, with sufficient bonding strength to maintain bib 10 in the position originally placed by the individual 12, but to release easily when it is to be removed, without leaving any portions of adhesive layer 22 on the clothing of the individual 12, and without pulling on or removing material from the individual's clothing.

Upper section 20 of bib 10 includes an upper edge 26. As shown in FIG. 2, upper edge 26 extends to form two optional opposing tabs 27, which may extend only to mid-chest level, below the individual's throat, may extend only to shoulder level (as shown), may extend further over the shoulders to drape thereover, or may extend in a curved manner to as to partially or completely circumscribe the individual's neck.

Figure 4:
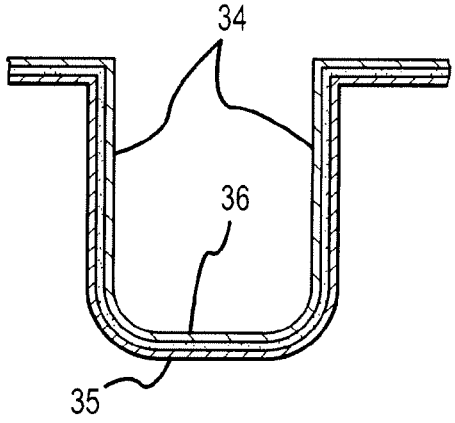
FIG. 4 is a cross section of the bib shown in FIG. 2 through section 4-4.

Bib 10 also includes a lower section 28 which extends downward from upper section 20 for covering the seated individual's lap and thighs. Bib 10 further includes a lateral section 30 extending generally laterally from lower section 28 to beyond vehicle cup holder 16. Most preferably, lateral section 30 extends at least 6 inches to the side of lower section 28. A cup holder portion 32 of lateral section 30 is adapted to be inserted in the vehicle cup holder 16. Referring now to FIG. 4, it can be seen that in the preferred embodiment, cup holder portion 32 include a cylinder 34 pre-formed in portion 32 which is closed at its lower end 36 and is open at the opposing upper end. When cylinder 34 is pre-formed in cup holder portion 32, it preferably has an outer diameter close to the inside diameter of the vehicle cup holder 16, so that cylinder 34 is maintained in place in the vehicle cup holder 16 by frictional engagement. Alternatively, the underside 35 of cup holder portion 32 of lateral section 30 may have adhesive mounted thereto (for example, as shown in FIG. 3), or may be a sufficiently tacky material to prevent cylinder 34 from slipping out of vehicle cup holder 16.

Figure 5:
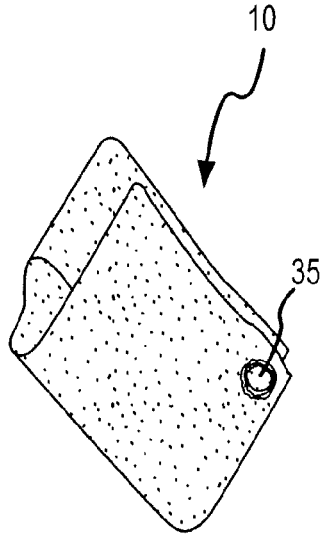
FIG. 5 illustrates the bib shown in FIGS. 1 and 2, folded prior to use.

FIG. 5 shows bib 10 folded prior to use. In this configuration, underside 35 is flush or almost flush with the underside of the rest of the lateral section 30, having been compressed in an accordion-like fashion. Later, when an individual prepares to put on bib 10, cup holder portion 32 is extended from the compressed form shown in FIG. 5 to a partially or fully extended form, as shown in FIG. 2.

An alternate attachment means for bib 10 is one in which adhesive layer is not present, and part or all of lower layer 23 comprises Neoprene™ or other similarly dense material, having a sufficient weight and/or density to resist slippage after bib 10 is in place on an individual. In such a configuration, the weight of opposing tabs 27 draped over the shoulder of the individual contributes to and may be sufficient to fully resist any undesired slippage. Alternatively, weights (not show) may be mounted in tabs 27 to at least partially counterbalance the weight of upper section 20.

Figure 6:
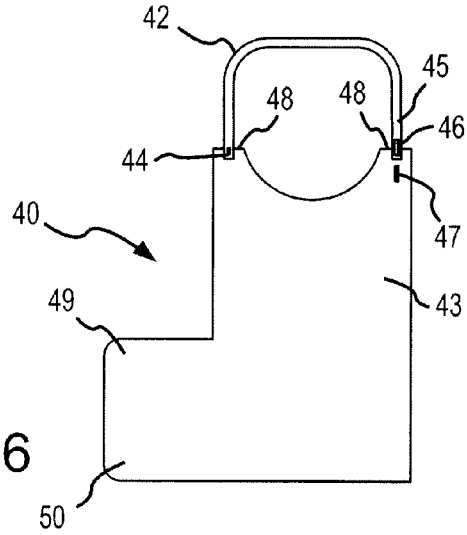
FIG. 6 is a plan view of an alternate embodiment of a bib of the present invention.
Figure 7:
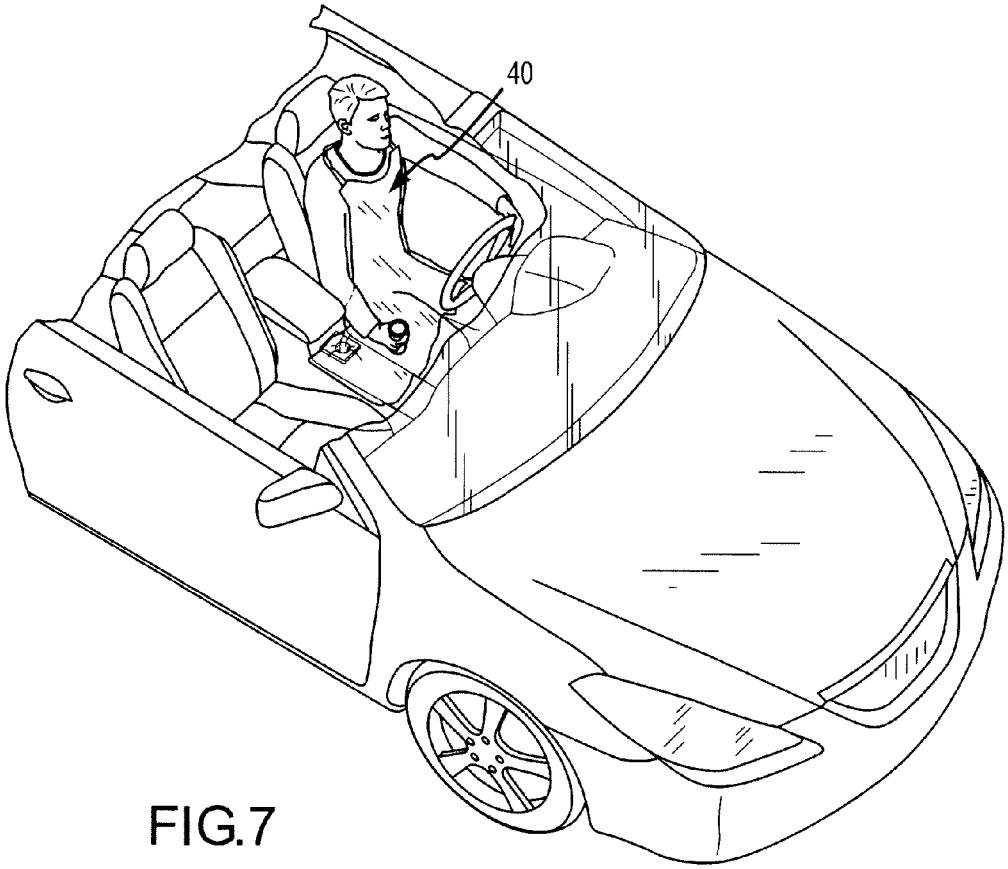
FIG. 7 illustrates the embodiment of FIG. 6 in use in a vehicle.

Referring now to FIGS. 6 and 7, an alternate embodiment of a bib 40, the attachment means comprises a strap-like tab 42 which is permanently attached to an upper corner 49 of upper section 43 of bib 40 at first strap end 44, and is removably attached at opposing second strap end 45 with a Velcro™ hook strip sewn at position 46 for releasable attachment to loop strip 47. An alternative attachment means includes a magnet mounted to second strap end 45 and a piece of iron or other magnet mounted to position 46. Another attachment means includes a pair of opposing straps attached a distance apart from each other at the opposing upper ends 49 of the upper section, designed to be tied together behind the individuals neck. Alternatively, the opposing strap ends are held behind the individual's neck by opposing magnets or magnet and metal piece.

In the alternative embodiment of bib 40 shown in FIG. 6, lateral section 49 does not have a cylinder pre-formed therein. Rather, the material of which at least the cup holder portion 50 of lateral section 49 is constructed is of sufficient flexibility to allow individual 12 to press cup holder portion 50 into the cylinder defined by cup holder 16. Preferably, the material of which cup holder portion 50 is made releasably maintains cup holder portion 50 in place, for example, as described above, by an adhesive mounted on the underside of the material, by the use of a naturally tacky underside surface, or by a magnetic material embedded in the lateral section. Bib 40 also preferably includes an upper absorbent surface for absorbing liquid spills and a lower impermeable surface for preventing liquid spills from contacting the seated individual or the vehicle.

Because cup holder portion 50 of bib 40 is not pre-formed, the location of the vehicle cup holder in a particular vehicle need not be predetermined. In such cases, where the shape of the bib and the portion of the lateral section is adapted to be inserted in the vehicle cup holder so as to work in different, unspecified vehicles, sufficiently large lower and lateral sections are made to allow that portion of the lateral section to be inserted in a wide variety of driver or passenger and console configurations, with excess bib material draped or gathered loosely between the driver or passenger and the cup holder being used.

Figure 8:
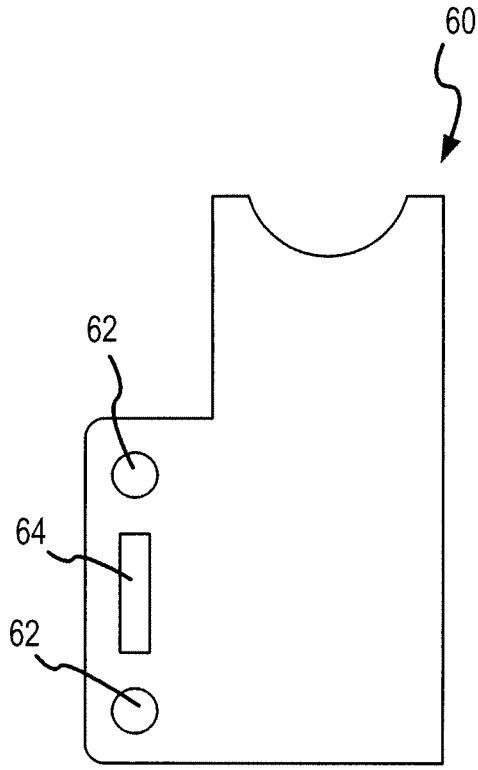
FIG. 8 illustrates an alternate embodiment of a bib of the present invention manufactured to a shape conforming to the center console of a particular vehicle model.

In yet other embodiment of the present invention, the shape and size of the bib, especially the lower and lateral sections, are dimensioned to fit a particular vehicle model and cup holder location. When a bib 60 is thus shaped for a particular vehicle model and cup holder location(s) in the center console, the lateral section must be shaped to avoid contact with and/or avoid engaging any gear or brake levers which extend from the center console, by circumscribing such vehicle parts. Optionally, the bib may additionally be sized for different-sized drivers, for example, in small, medium, large and extra-large sizes. Referring now to FIG. 8, it can be seen that bib 60 includes a pair of cup holder portions 62 formed therein, along with a rectangular slot portion 64, in dimensions and position mirroring an underlying vehicle console. Also optionally, bib 60 is perforated at perforation 65, so that the lateral section of bib 60 which covers the center console of the vehicle, can be separated from the rest of bib 60 when the individual disembarks the vehicle, thereby leaving a protective cover on the center console.

Figure 9:
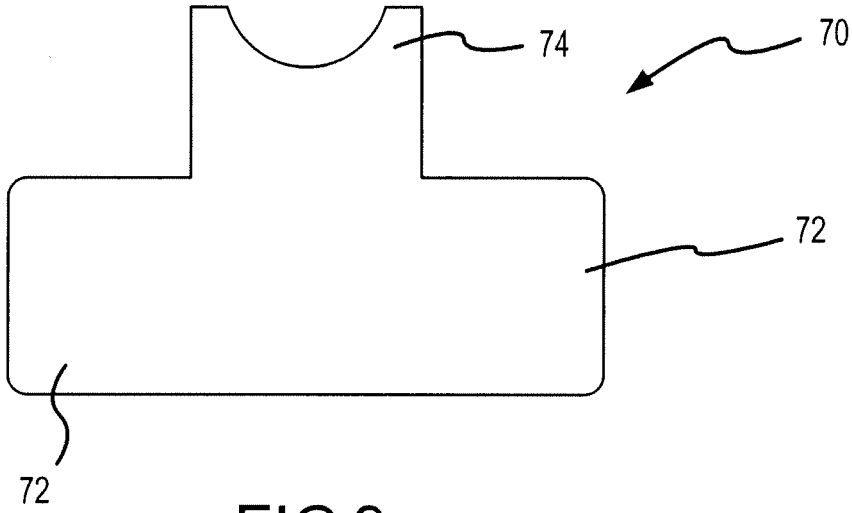
FIG. 9 is a plan view of an alternate embodiment of a bib of the present invention.

A bib 70 shown in FIG. 9 is adapted for use by an individual in a vehicle, for example, a passenger in the back seat, where the location of the cup holder is not known. In such cases, bib 70 includes a pair of opposing lateral sections 72, one or both of which can be used to insert into vehicle cup holders on either or both sides of the individual. Bib 70, as shown, is made to include an adhesive backing on the underside of upper portion 74 and also on the underside of lateral portions 72.

Figure 10:
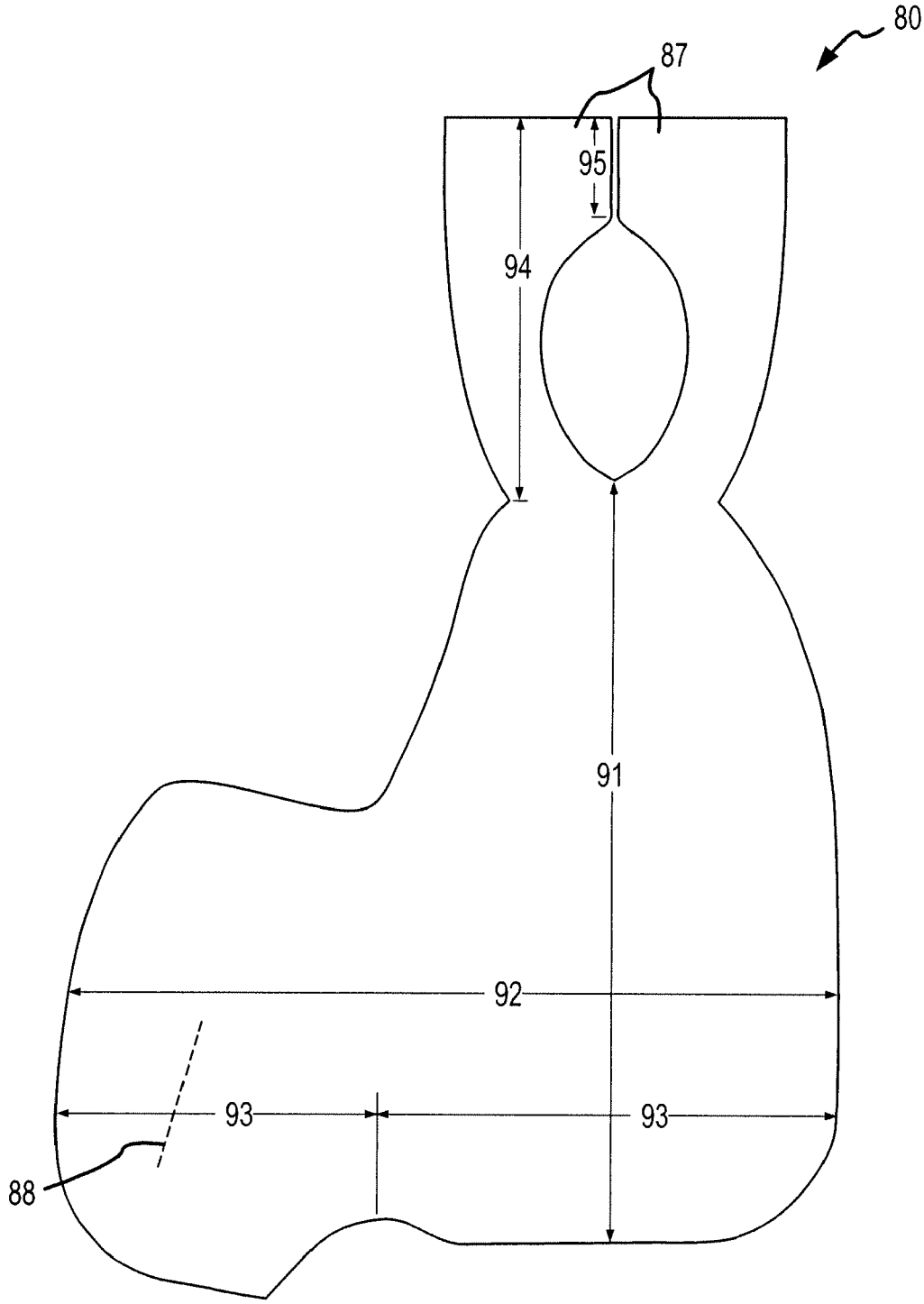
FIG. 10 is a plan view of another embodiment of a bib of the present invention.

As described above relative to the exemplary bib shown in FIG. 2, opposing tabs 27 may extend further over the shoulders to drape thereover. An embodiment illustrating this configuration is shown in FIG. 10, in which a bib 80 includes elongated tabs 87 which extend beyond the back of the neck of the driver (or passenger wearing the bib) and down to the back of the shoulders (i.e., to at least the scapula of the wearer, or beyond). In use, elongated tabs 87 become sandwiched between the wearer and the seatback, so that bib 80 is maintained in place by the frictional engagement of the wearer leaning against the seatback. In this way, elongated tabs 87 constitute means associated with the upper section for maintaining the upper section in a substantially vertical position on the seated wearer. Of course elongated tabs 87 may be employed with other embodiments of the present invention discussed above. In a preferred embodiment of bib 80 for use by an adult male, length 91 which a combined length of upper and lower sections is preferably about 36", width 93 of the lower section is preferably about 21.5" and width 94 across the lateral section is approximately 14.75", so that the total width 92 of the bib 80 across the lower and lateral sections is preferably at least 36". In order for elongated tabs 87 to extend partially down the back of the wearer, distance 94 from the front of the neck to the end of elongated tabs 87 is preferably at least 19.25", with the tab extending beyond the back of the neck of the wearer a length 95 of preferably 5".

Bib 80 also includes a perforation 88 which may be separated to form a slit adapted to allow the gear stick to pass through and to extend the length of the channel along with the gear stick travels when shifted from park to reverse, neutral and drive speed positions. This feature may be employed in the other embodiments of the present invention described herein.

In the embodiment of the present invention shown in FIG. 10, bib 80 is made of a two ply material, with the outwardly facing side employing an absorbent material and the underside of a plastic or other material preventing spilled materials from contacting the wearer's clothing. In this embodiment, the material is inserted into the cup holder, with a beverage container (i.e., cup, bottle, etc.) then placed therein, so that the weight of the container and beverage contributes to maintaining the bib material in place in the cup holder, thereby constituting a means associated with the lateral section for maintaining in place the portion of the lateral section inserted in the vehicle cup holder. Of course other means associated with the lateral section for maintaining in place the portion of the lateral section inserted in the vehicle cup holder described above, can also be incorporated into bib 80.

While there have been described above the principles of the present invention in conjunction with specific compositions, application rates and crops, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

The invention claimed is:

1. A bib for use by an individual seated in a vehicle having a vehicle cup holder mounted in the vehicle adjacent the seated individual, the bib comprising:

an upper section for covering at least a portion of the seated individual's front torso, the upper section having a front, back, and upper edge;

means associated with the upper section for maintaining the upper section in a substantially vertical position on the seated individual;

a lower section for covering the seated individual's lap and thighs;

a lateral section extending from the lower section to beyond the vehicle cup holder and including a perforation adapted to be separated into a slit through which the vehicles gear stick extends, wherein a portion of the lateral section is adapted to be inserted in the vehicle cup holder;

means associated with the lateral section for maintaining in place the portion of the lateral section inserted in the vehicle cup holder, wherein the bib includes an absorbent layer for absorbing liquid spills and a lower impermeable layer for preventing liquid spills from contacting the seated individual or the vehicle.

2. The bib of claim 1, wherein the means associated with the upper section for maintaining the upper section in a substantially vertical position on the seated individual comprises a pair of opposing tabs extending from the upper edge of the upper section to extend over the shoulders of the individual.

3. The bib of claim 1, wherein the means associated with the upper section for maintaining the upper section in a substantially vertical position on the seated individual comprises a pair of opposing tabs which are releasably attached together behind the seated individual's neck by means selected from the group consisting of (i) opposing ties extending from each of the opposing tabs; (ii) opposing magnets, one mounted on each of the opposing tabs; (iii) opposing hook and loop fasteners, the hook fastener being mounted on one of the opposing tabs and the loop fastener being mounted on the other of the opposing tabs; and (iv) an adhesive on at least one of the opposing tabs.

4. The bib of claim 1, wherein the means associated with the upper section for maintaining the upper section in a substantially vertical position on the seated individual is an adhesive on the back of the upper section.

5. The bib of claim 1, wherein the means associated with the lateral section for maintaining in place the portion of the lateral section inserted in the vehicle cup holder is an adhesive on the back of the lateral section.

6. The bib of claim 1, wherein the means associated with the lateral section for maintaining in place the portion of the lateral section inserted in the vehicle cup holder is a permanent cylindrical shape formed in the portion of the lateral section and adapted for being received in the vehicle cup holder.

7. The bib of claim 4, wherein the means associated with the lateral section for maintaining in place the portion of the lateral section inserted in the vehicle cup holder is a permanent cylindrical shape formed in the portion of the lateral section and adapted for being received in the vehicle cup holder.

8. The bib of claim 1, wherein the lower section has an average material density which is greater than the average material density of the upper section.

9. The bib of claim 1, wherein the vehicle includes a driver's seat and a center console adjacent the driver's seat and the vehicle cup holder is formed in the center console, and wherein the lateral section is sized to cover areas of the center console adjacent the cup holder and other portions of the center console but is prevented from interfering with operational elements of the console including levers and knobs extending from the console and indicia adjacent the levers and knobs, by an adhesive mounted to the back of the lateral section adapted to allow the individual to press the lateral section to the center console in a manner which circumscribes the operational elements.

10. The bib of claim 1, wherein the vehicle includes a driver's seat and a center console adjacent the driver's seat and the vehicle cup holder is formed in the center console, and wherein the lateral section is sized to cover areas of the center console adjacent the cup holder and other portions of the center console but is prevented from interfering with operational elements of the console including levers and knobs extending from the console and indicia adjacent the levers and knobs, by a peripheral edge of the lateral section which is shaped to circumscribe the operational elements of a particular vehicle.

11. The bib of claim 1, wherein the means associated with the upper section for maintaining the upper section in a substantially vertical position on the seated individual comprises a pair of opposing tabs which are releasably attached together.

12. The bib of claim 1, further comprising adhesive on the back of the upper section of the bib for contacting and adhering to clothing on the torso of the individual to maintain the upper section of the bib in a substantially vertical position on the individual.

13. The bib of claim 12, wherein the upper section of the bib includes a strap-like tab extending from the upper section of the bib to behind the neck of the individual and having a strap end adapted to contact the adhesive on the upper section of the bib.

14. The bib of claim 13, wherein the upper section includes a second strap end on which the adhesive is located.

15. A bib for use by an individual seated in a vehicle having a vehicle cup holder mounted in the vehicle adjacent the seated individual and a center console having a gear stick extending therethrough, the bib comprising:

an upper bib component for covering at least some of the individual's front torso, the upper bib having a front, a back, an upper edge and lower periphery; and a lower bib component extending horizontally from the lower periphery of the upper bib, the lower bib component including a lap-covering portion for draping over the individual's lap; and an extension section sized to extend from the lap-covering portion to the vehicle cup holder and over the center console, and adapted for mounting a portion of the extension section in the vehicle cup holder, with a perforation formed in the extension section through which the gear stick extends, wherein the bib includes an absorbent material for absorbing liquid spills and an impermeable material for preventing liquid spills from contacting the individual or the vehicle.

16. The bib of claim 15, further comprising adhesive on the upper component of the bib to maintain the upper component of the bib in a substantially vertical position on the individual.

17. The bib of claim 15, further comprising a strap-like tab extending from the upper component of the bib to behind the neck of the individual.

18. The bib of claim 16, further comprising a strap-like tab extending from the upper component of the bib to behind the neck of the individual.

19. The bib of claim 17, wherein the strap-like tab includes a first strap end and a second strap end extends from the upper component of the bib.

20. The bib of claim 18, wherein the strap-like tab includes a first strap end and wherein a second strap end extends from the upper component of the bib.

* * * * *